US005193854A

United States Patent [19]

Borowski, Jr. et al.

[11] Patent Number: 5,193,854

[45] Date of Patent: Mar. 16, 1993

[54] TAMPER-RESISTANT ARTICLE AND METHOD OF AUTHENTICATING THE SAME

[75] Inventors: Joseph C. Borowski, Jr., Hatfield, Pa.; Robert O. Fulton, Ontario, Canada; Jacques Lavoie, Lansdale, Pa.

[73] Assignee: BABN Technologies Inc., Quebec, Canada

[21] Appl. No.: 843,550

[22] Filed: Feb. 28, 1992

[51] Int. Cl.[5] ..... B42D 15/00

[52] U.S. Cl. ..... 283/87; 283/93; 283/94; 283/902; 283/903; 359/43; 359/288

[58] Field of Search ..... 283/902, 87, 903, 93, 283/94; 359/43, 288

[56] References Cited

U.S. PATENT DOCUMENTS

| | | | |
|---|---|---|---|
| 3,597,082 | 8/1971 | James et al. | 355/133 |
| 3,713,861 | 1/1973 | Sharp | 283/902 X |
| 3,895,755 | 7/1975 | McCarthy | 229/83 |
| 4,066,280 | 1/1978 | LaCapria | 283/902 X |
| 4,120,445 | 10/1978 | Carrier et al. | 229/53 |
| 4,227,719 | 10/1980 | McElligott et al. | 283/92 |
| 4,241,942 | 12/1980 | Bachman | 283/903 X |
| 4,407,443 | 10/1983 | McCorkle | 283/94 X |
| 4,488,646 | 12/1984 | McCorkle | 283/94 X |
| 4,936,916 | 6/1990 | Shinmitsu et al. | 106/21 |

FOREIGN PATENT DOCUMENTS

| | | |
|---|---|---|
| 1158104 | 12/1983 | Canada . |
| 2188283 | 9/1987 | United Kingdom . |

*Primary Examiner*—Paul A. Bell
*Attorney, Agent, or Firm*—Watov & Kipnes

[57] ABSTRACT

A printed document, such as a lottery ticket, includes a thermochromic layer at least over the imprinted data region. The printed document can be authenticated by applying heat to the thermochromic material and observing the presence or absence of a reversible color change.

11 Claims, 1 Drawing Sheet

TAMPER-RESISTANT ARTICLE AND METHOD OF AUTHENTICATING THE SAME

FIELD OF THE INVENTION

The present invention is directed to a tamper-resistant article and particularly to printed documents such as negotiable instruments and lottery tickets employing a thermochromic material for on-site authentication.

BACKGROUND OF THE INVENTION

State and local lotteries have become important fund raising events for the sponsoring agency. The popularity of lotteries has soared in the 1980's and continues to grow.

Those agencies charged with the administration of lotteries are acutely aware of the need to maintain the integrity of the lottery system from the printing of lottery tickets to the validation of prize winning numbers. Accordingly, much effort has been made to insure that all tickets are authentic. It is generally recognized that in order for a lottery game to be successful, from the point of view of both the purchaser and the sponsor, the lottery ticket must be secure against counterfeiting.

Scratch-off type lottery tickets are those having at least one area overprinted with an opaque latex ink. When the latex ink dries it forms a protective coating that can be scratched off to reveal preprinted indicia indicating whether or not a prize has been won.

In the early 1980's, scratch-off type lottery tickets were printed on a foil-laminated substrate. The reflectance of the substrate made it difficult for counterfeiters to photocopy a winning ticket. Since the foil reflects all wavelengths of the electromagnetic spectrum, a photocopy shows black in the foil area, thus making detection of a counterfeit ticket relatively easy.

In the late 1980's the use of foil laminated substrates was criticized on environmental grounds. The foil is not biodegradable and can not be readily recycled. Accordingly, lottery sponsors have encouraged lottery ticket manufacturers to create an environmentally compatible lottery ticket which can be authenticated with the same degree of assurance as foil laminated tickets. Virgin and preferably recycled paper are preferred substrates for environmentally compatible lottery tickets.

Authentication of a non-foil paper substrate was complicated by the development of high quality color photocopiers which occurred in the late 1980's. Such copiers are capable of duplicating a winning ticket with a high degree of precision even for multicolored lottery tickets. In addition, authentication of valid winning tickets is primarily the responsibility of the lottery ticket retailer. He or she is charged with the responsibility of visually checking the ticket to detect any signs of tampering or duplication. However, retail agents often do not have the time to carefully check winning tickets, particularly during peak sale periods. Furthermore, any equipment which may be required for authentication, such as ultraviolet light is either too time consuming or bulky for convenient use by retail agents.

There have been a variety of efforts proposed to prevent tampering of lottery tickets. One such method has been the use of inks which undergo an irreversible color change when exposed to elevated temperatures. For example, James McCorkle, U.S. Pat. Nos. 4,407,443 and 4,488,646 and Canadian Patent No. 1,158,104 disclose a lottery ticket using a blush coating composition which employs a mass of dispersed light-scattering polymeric particles. The polymeric particles are activated into an irreversible color change when exposed to heat or organic solvents. Lee A. Carrier U.S. Pat. No. 4,120,445 discloses an irreversible color change in the form of a blush-coat type of composition. A first laminate is carried on a paper substrate which includes a radiation-blocking coating as well as irreversible coloring agents which are susceptible to chemical agents or are heat-sensitive.

The use of irreversible coloring agents to prevent tampering suffers from a number of disadvantages. Lottery tickets using irreversible color changes are subject to a relatively high number of "false voidings". An unintended color change due to accidental exposure to a chemical or to heat can result in a valid ticket being rendered invalid. In addition, irreversible inks generally require pretreatment of the paper substrate which adds to the cost of producing the lottery ticket.

Another approach to securing a scratch off lottery ticket is disclosed in Gilbert Bachman, U.S. Pat. No. 4,241,942. The lottery ticket employs a patterned layer of material to render visually hidden indicia on the ticket indistinguishable to a photocopy machine. The patterned layer renders any light rays which may be transmitted from the indicia to the paper of the photocopy process indistinguishable from the light rays transmitted from the patterned layer to the paper. As a result, the image which appears on the photocopy does not disclose the hidden indicia.

Fluorescent inks have also been used to prevent counterfeiting because the colors are not readily reproducible. For example, Herbert Laxer, U.S. Pat. No. 3,886,083 discloses a soluble and bleachable dye in combination with a fluorescent pigment whose fluorescence is enhanced if an alteration is attempted.

Anthony LaCapria, U.S. Pat. No. 4,066,280 discloses a document which has two overlapping but non-registering imprints. One of the imprints can be reproduced by a photocopier. The other imprint is from an ink including a specularly reflective opaque coloring material which partially masks a fluorescent material. The fluorescent material cannot be reproduced by a copier so that any attempt to photocopy the original ticket will fail to produce an exact duplicate.

All of the above mentioned methods of deterring the production of counterfeit tickets are disadvantageous because they are subject to false invalidations, require pretreatment of the substrate and/or do not provide a convenient means for on-site authentication of a winning ticket. A lottery ticket which can be rapidly and accurately authenticated by the retail agent would enhance lottery sales and improve the integrity of the lottery system.

All of the advantages would likewise be beneficial for the printing of negotiable instruments in which on-site authentication is of critical importance.

SUMMARY OF THE INVENTION

The present invention is generally directed to printed documents such as negotiable instruments and game cards, such as a lottery ticket, which can be rapidly and accurately authenticated at the site of the financial institution in the case of negotiable instruments and by the retail agent in the case of lottery tickets. The game card or negotiable instrument comprises a substrate having data imaged on a portion of the substrate. The data may be any information which is customarily found on such documents.

Placed over at least the data imaged portion of the substrate is a layer of a thermochromic material which is capable of undergoing a reversible color change. The thermochromic layer may also be placed over all or a part of the substrate which does not have the data imprinted thereon.

In one embodiment of the invention, a scratch-off type lottery ticket has game data imaged on a portion of the substrate. A scratch-off layer, which can readily be removed by the purchaser, is placed upon the thermochromic layer and covers the game data thereby preventing visual observation. When an individual purchases a game card, he or she removes the scratch-off layer with a suitable blunt instrument such as a coin to reveal the game data. If the game card is a winner, the purchaser brings the game card to the retail agent for payment. The retailer then applies the requisite heat to the thermochromic layer, preferably by contacting the layer with a finger. If the layer changes color and then reverts to the original color upon cooling, the ticket is an authentic ticket. If the color does not change or the color change is irreversible then the ticket is invalid.

The employment of a thermochromic layer over the game data is advantageous because it provides the opportunity for instant on-site authentication without the use of specialized equipment. Furthermore, a counterfeit photocopy of the ticket can be instantly detected because the photocopy can not duplicate the reversible color change created by the thermochromic layer. Still further, the thermochromic layer cannot readily be altered from a losing ticket to a winning ticket, and therefore the present invention prevents artistic counterfeiting.

BRIEF DESCRIPTION OF THE DRAWINGS

The following drawings are illustrative of embodiments of the invention and are not intended to limit the invention as encompassed by the claims forming part of the application.

FIG. I is an elevational view of one embodiment of a lottery ticket in accordance with the present invention.

DETAILED DESCRIPTION OF THE INVENTION

Figure 1:
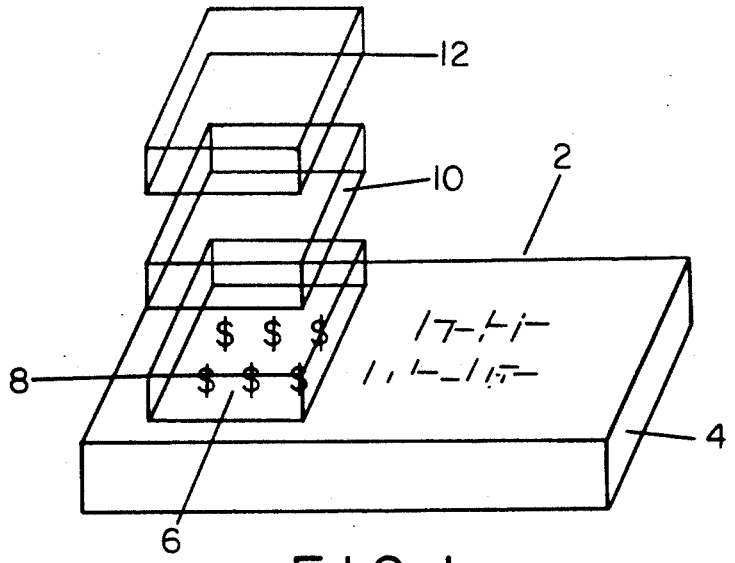

The present invention provides for the on-site authentication of a document such as a negotiable instrument or lottery ticket through the use of a thermochromic layer which undergoes a color change when exposed to heat. The thermochromic layer reverts to the original color when allowed to cool. Referring to FIG. 1, there is shown a partial view of a lottery ticket game card, such as in the form of a scratch-off type lottery ticket 2 which includes a substrate 4 having imprinted thereon game data 6.

Superimposed over the game data 6 is a thermochromic layer 8 which undergoes a reversible color change when exposed to heat. A release coat 10, preferably made of a clear varnish, may be optionally coated over the thermochromic layer 8 to protect the same against damage as explained hereinafter. The layers described above are all sufficiently transparent so as to allow the game data 6 to be read by the purchaser.

Figure 2:
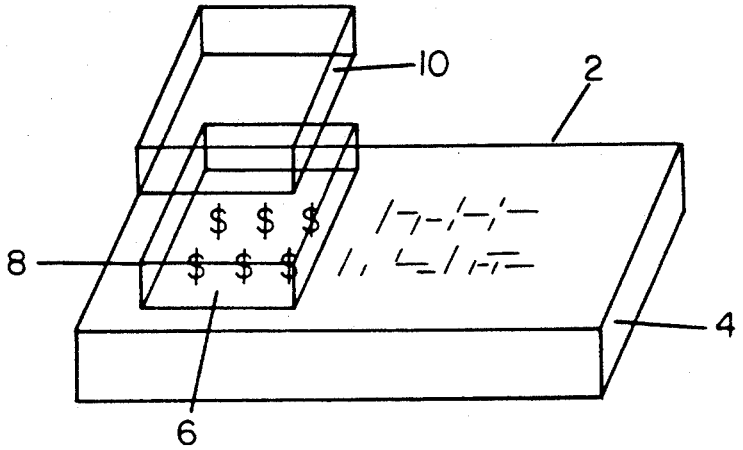
FIG. 2 is a view similar to Figure showing a scratch-off layer removed thereby exposing the game data.

Visual observation of the game data is prevented by at least one opaque latex layer 12. The latex layer 12 covers the game data 6 until the purchaser removes the latex layer 12 with a blunt instrument such as a coin. The game data may then be visually observed by the purchaser as shown in FIG. 2. During the removal of the latex layer 12, the release coat 10 protects the thermochromic layer 8 from damage.

The substrate 2 may be any material suitable for making a game card such as a foil laminate. However, since the foil is not biodegradable or recyclable, it is preferred to use virgin or recycled paper as the substrate.

The thermochromic layer is composed of a water base coating containing acrylic resins such as BF-202 made by Performance Coating Company of Bristol, Pennsylvania and a slurry containing the thermochromic material. The slurry contains an oil and a leuco dye and is microencapsulated with particle sizes preferably in the range of 2 to 10 microns. The dyes are typically in the form of thermochromic liquid crystal inks which are composed of microcapsules of liquid crystals in a clear aqueous resin binder such as Chromazone made by Davis Liquid Crystals of San Leandro, Calif. The microcapsule is typically a thin shell of cross-linked gelatin and the binder is typically an aqueous solution or emulsion of a polyvinyl acetate or acrylic polymer or copolymer. Alternatively, the microcapsule can be made from melamine-from aldehyde resin as disclosed in U.S. Pat. No. 4,936,916, incorporated herein by reference. The thermochromic dyes can be formulated to reversibly change color in response to body heat although other temperature ranges can be routinely formulated. The amount of the slurry containing the thermochromic material is preferably 5 to 50 weight % based on the total weight of the thermochromic coating layer including the water base coating.

EXAMPLE

A lottery ticket in accordance with the present invention was prepared by imprinting one or more graphic display inks on a non-foil recycled paper stock. Thereafter, game data was imaged on to the paper stock in a select location.

A water base coating containing thermochromic material Chromazone made by Davis Liquid Crystals of San Leandro, Calif. was imprinted over the game data to form a thermochromic layer containing about 50% by weight of the slurry. At room temperature the thermochromic layer had a pale blue color. When exposed to body heat the color changed to clear. A clear varnish was then coated over the thermochromic layer to provide a protective layer for the thermochromic material.

Thereafter, the clear varnish coat was coated with several layers of scratch-off latex customarily used in the manufacture of game cards.

The purchaser of the game card removes the scratch-off latex with a coin or the like to expose the game data which is covered by the pale blue colored thermochromic layer. If the game card is a winner, he or she brings the game card to an authorized retail agent. The agent applies body heat to the game card, preferably by touching the thermochromic layer with a finger. This causes the pale blue thermochromic layer to change to a clear layer. Upon removing the finger, the clear layer instantaneously reverts to the original pale blue color. This color change and reversal indicates that the ticket is authentic and that the retailer may award the prize.

Figure 3:
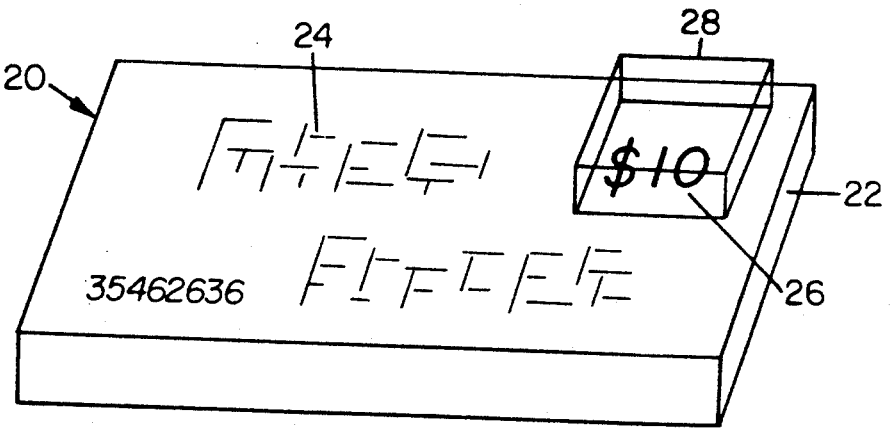
FIG. 3 is an elevational view of another embodiment of the invention applied to a negotiable instrument.

The present invention may also be applied to the authentication of negotiable instruments. Referring to FIG. 3, there is shown a negotiable instrument 20 such as a traveler's check having substrate 22 with indicia 24 printed thereon. A portion of the instrument has thereon indicia 26, such as a dollar amount, which is covered by a thermochromic layer 28. The thermochromic layer may be of the same type described above in connection with the lottery ticket. When the negotiable instrument is presented for payment at a financial institution, the agent applies heat to the thermochromic layer 28 such as by contacting the layer with a finger. If the layer 28 undergoes a reversible color change, then the instrument is authentic and the agent can proceed to pay the face value to the bearer.

We claim:

1. A printed document which is in the form of a lottery ticket comprising:

(a) a substrate;

(b) game data imaged on a portion of the substrate which when exposed determines if a prize has been won;

(c) a layer of a thermochromic material, capable of undergoing a reversible color change upon exposure to heat, placed over at least the game data portion of the substrate with said game data being visible therethrough; and (d) a scratch-off layer placed upon the portion of the thermochromic layer which covers the game data and adapted to be removed by the user to reveal the game data.

2. The printed document of claim 1 wherein the thermochromic material comprises a mixture of a water base material and a slurry containing a microencapsulated oil and leuco dye.

3. The printed document of claim 1 wherein the layer of thermochromic material covers only the game data portion of the substrate.

4. The printed document of claim 1 wherein the substrate is made from a material selected from the group consisting of virgin and recyclable paper.

5. The printed document of claim 1 wherein the lottery ticket is printed on a foil laminated substrate.

6. The printed document of claim 3 wherein the substrate is made from a material selected from the group consisting of virgin and recyclable paper.

7. A method of authenticating a printed document, said printed document comprising:

(a) a substrate;

(b) game data imaged on a portion of the substrate which when exposed determines if a prize has been won;

(c) a layer of thermochromic material, capable of undergoing a reversible color change upon exposure to heat, placed over at least the game data portion of the substrate with said game data being visible therethrough; and (d) a scratch-off layer placed upon the portion of the thermochromic layer which covers the game data and adapted to be removed by the user to reveal the game data, said process comprising removing the scratch-off layer and heating the thermochromic layer to a temperature sufficient to cause a reversible color change, whereby if a reversible color change does not occur, the printed document is not authentic.

8. The method of claim 7 wherein the substrate is made from a material selected from the group consisting of virgin and recyclable paper.

9. The method of claim 7 wherein the layer of thermochromic material covers only the game data portion of the substrate.

10. The method of claim 9 wherein the substrate is made from a material selected from the group consisting of virgin and recyclable paper.

11. The method of claim 7 wherein the step of heating the thermochromic layer is performed by contacting the thermochromic layer with a part of the human body.

* * * * *